US005774323A

United States Patent [19]

Innes et al.

[11] Patent Number: 5,774,323

[45] Date of Patent: Jun. 30, 1998

[54] DETECTION OF CONTACT POSITION FROM COIL CURRENT IN ELECTROMAGNETIC SWITCHES HAVING AC OR DC OPERATED COILS

[75] Inventors: Mark E. Innes; John H. Blakely, both of Asheville, N.C.

[73] Assignee: Eaton Corporation, Cleveland, Ohio

[21] Appl. No.: 558,605

[22] Filed: Oct. 31, 1995

[51] Int. Cl.[6] ..... H01H 47/22

[52] U.S. Cl. ..... 361/187; 361/209; 340/644; 324/418

[58] Field of Search ..... 324/418, 423, 324/422, 207.15; 340/644; 361/187, 152, 153, 154, 160, 170, 209

[56] References Cited

U.S. PATENT DOCUMENTS

| | | | |
|---|---|---|---|
| 4,980,794 | 12/1990 | Engel | 361/187 |
| 5,053,911 | 10/1991 | Kopec et al. | 361/154 |
| 5,204,633 | 4/1993 | Ahladas et al. | 324/418 |
| 5,243,296 | 9/1993 | Ando et al. | 324/418 |
| 5,293,551 | 3/1994 | Perkins et al. | 361/154 |
| 5,539,608 | 7/1996 | Hurley et al. | 361/152 |

*Primary Examiner*—Fritz Fleming
*Attorney, Agent, or Firm*—Larry G. Vande Zande

[57] ABSTRACT

An electromagnetic switch for opening and closing a set of contacts has a microprocessor which monitors coil current to determine the state of the contacts. The switch relies on the phenomenon that the inductance of the switch coil changes significantly between the open position of the contacts when the switch armature carrying the moveable contact is spaced by an air gap from the core of the electromagnet, and the closed position in which the armature abuts the core. For an AC energized coil, which is self-limiting in that the increase in inductance from closing of the contacts reduces the current to the holding value automatically, a coil current of less than about one/half of the nominal open contact value is an indication that the contacts are closed. For a DC coil, where the coil current is regulated by a current regulator to a closing value and a holding value, the coil current is measured and then the current regulator is turned off for an interval during which time the current is recirculated through a fly back diode connected across the coil. After a period of time, which in the preferred embodiment is one cold, open time constant of the coil, coil current is measured again. If the second value of coil current is less than about one/half of the initial value, the contacts are open, otherwise the contacts are closed.

9 Claims, 5 Drawing Sheets

DETECTION OF CONTACT POSITION FROM COIL CURRENT IN ELECTROMAGNETIC SWITCHES HAVING AC OR DC OPERATED COILS

BACKGROUND OF THE INVENTION

1. Field of the Invention

This invention relates to detection of contact position in electromagnetic switches having either AC or DC coils, and particularly to such switches used in contactors, motor starters and motor controllers.

2. Background Information

Switches used in electric power distribution systems to control energization of loads typically have an electromagnet which opens and closes contacts in the power conductors. Such switches are known as contactors. Often the contactor is combined with an overload relay which de-energizes the electromagnet of the contactor to open the contacts in response to overload conditions. Such a combination of a contactor and an overload relay is known as a motor starter or motor controller.

The electromagnet in the contactor has a magnetically permeable core on which the coil is wound. Energization of the coil generates magnetic flux which attracts an armature carrying movable contacts toward the core to bring the movable contacts into engagement with fixed contacts to complete the load circuit. Contact springs permit the armature to over-travel when the main contacts close to maintain a specified contact pressure and to accommodate for contact wear. A kick-out spring biases the armature away from the core to open the main contacts when the coil is de-energized. Of course, energization command of the coil is an indirect indication that the contacts are closed. Also, detection by the overload relay of current flowing in the load circuit is indication that the contacts are closed. However, there are instances where it is desirable to have an independent indication of the actual position of the main contacts of the contactor. Typically, this indication is provided by auxiliary contacts which are actuated by the armature. In addition to requiring another set of mechanical contacts, more wiring and additional control inputs are also needed. This burden is compounded in the case of reversers where separate starters are required for energizing a motor to run in each of two directions, and in two-speed motors where separate starters are required for energizing the low speed coil and the high speed coil of the motor.

Independent of the type of power in the distribution system being controlled by the contactor or motor starter, either an AC or a DC coil can be used in the electromagnet of the contactor. In either case, a large coil current is needed initially to overcome the inertia of the armature, losses in the air gap, and the spring force holding the armature open. Once the contacts are closed a lower current is sufficient to maintain the contacts in the closed position. This is because closure of the contacts brings the armature into contact with the core thereby eliminating the gap in the magnetic circuit of the electromagnet. This reduction in the reluctance of the magnetic circuit reduces the level of current needed to hold the contacts closed. It is good practice to reduce coil current for holding to minimize power consumption and to avoid overheating the coil.

In the case of a DC coil, a split coil and external switch, or a current regulator are used to set and maintain the closing and holding currents. Separate regulation is not required in the case of the AC coils since the increase in inductance of the coil resulting from the seating of the armature against the core provides automatic current regulation.

There is a need for an improved electromagnetic switch such as a contactor or motor starter which provides a reliable indication of actual contact position. There is a related need for such an improved electromagnetic switch which does not require auxiliary contacts and the attendant wiring.

SUMMARY OF THE INVENTION

These needs and others are satisfied by the invention which is directed to an electromagnetic switch having means for detecting the actual position of the contacts from coil current for both AC and DC operated coils. The present invention is based on the principle that there is a very significant increase in the inductance of the coil of the electromagnet in the switch when the gap in the magnetic circuit between the armature and the core is eliminated as the armature seats against the core and simultaneously closes the main contacts. Furthermore, even a very small gap between the armature and the core causes a large reduction in the coil inductance so that not only contact position, but the amount of contact pressure can be determined from the inductance of the coil.

In accordance with the invention, the determination of the coil inductance and therefore the position of the contacts is made from measurements of the coil current. With a fixed voltage applied to the coil, the increase in inductance resulting from the seating of the armature on the core causes a reduction in the current. It is recognized that there is a two to one ratio of resistance between a cold and a hot coil which will also effect coil current. However, in the case of an AC coil, there is about a six to one ratio in the inductance of the coil from closed to open. Thus, the inductance dominates the impedance of the coil, and by determining whether the AC coil current is above or below a reference value, it can be determined whether the contacts are closed or open.

In the case of the DC coil, in which the current is regulated by a regulator and not just by the inductance of the coil, the coil current is measured and then the current is turned off for a period of time. During this period, the current in the coil is recirculated such as through a fly back diode. The duration of this interval is selected so that it is less than the time required for the holding current to decay below the threshold for drop out. In the preferred embodiment of the invention, this interval is selected as one cold time constant for the coil. Typically, the current will decay to about 87 percent of its initial value during one closed constant. It is normal to provide a holding current which is twice the drop out current, so that the decay of the DC coil current during the one cold time constant is considerably less than the reduction required for the coil to drop out.

More particularly, the invention is directed to an electromagnetic switch having a set of separable contacts comprising fixed contacts and movable contacts, an electromagnet for opening and closing the separable contacts and comprising a core, a coil and an armature on which the movable contacts are carried, means energizing the coil to generate coil current and attract the armature toward the core to a closed position to bring the movable contacts into contact with the fixed contacts and thereby close the separable contacts, bias means biasing the armature away from the core to an open position in which a gap exists between the core and the armature, wherein the coil has a first inductance when the armature is in the open position and a second inductance when the armature is in the closed position. The electromagnetic switch further includes position indicating means generating a position signal indicating armature position and therefore contact position as a function of the coil current as affected by the first inductance and the second inductance.

BRIEF DESCRIPTION OF THE DRAWINGS

A full understanding of the invention can be gained from the following description of the preferred embodiments when read in conjunction with the accompanying drawings in which.

DESCRIPTION OF THE PREFERRED EMBODIMENT

The invention has particular application and will be described in connection with a motor starter. However, it will be realized by those skilled in the art that the invention has broad application for determining the position of the contacts in electromagnetic switches utilized in other applications.

Figure 1:
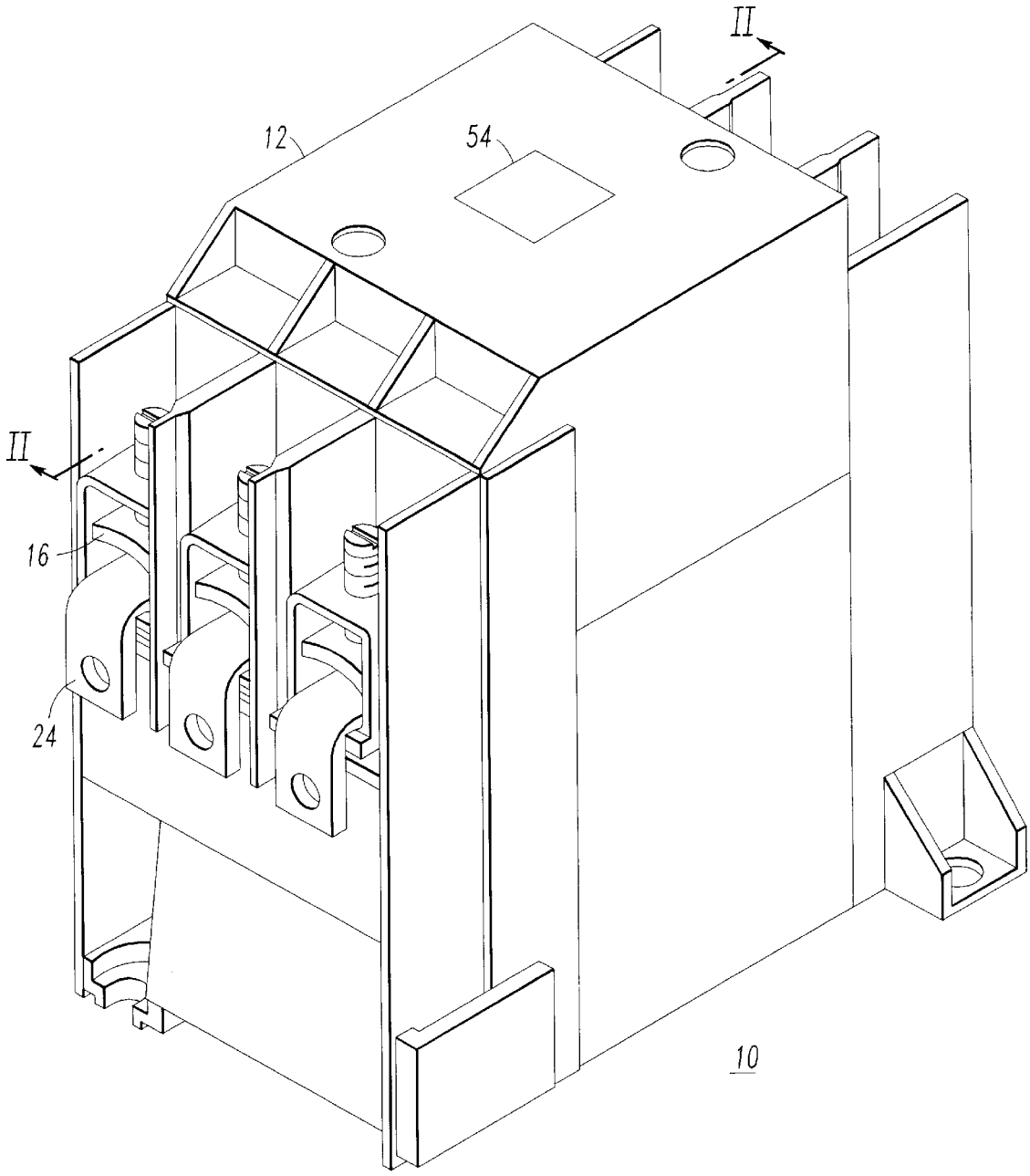
FIG. 1 is an isometric view of a motor starter incorporating the invention.
Figure 2:
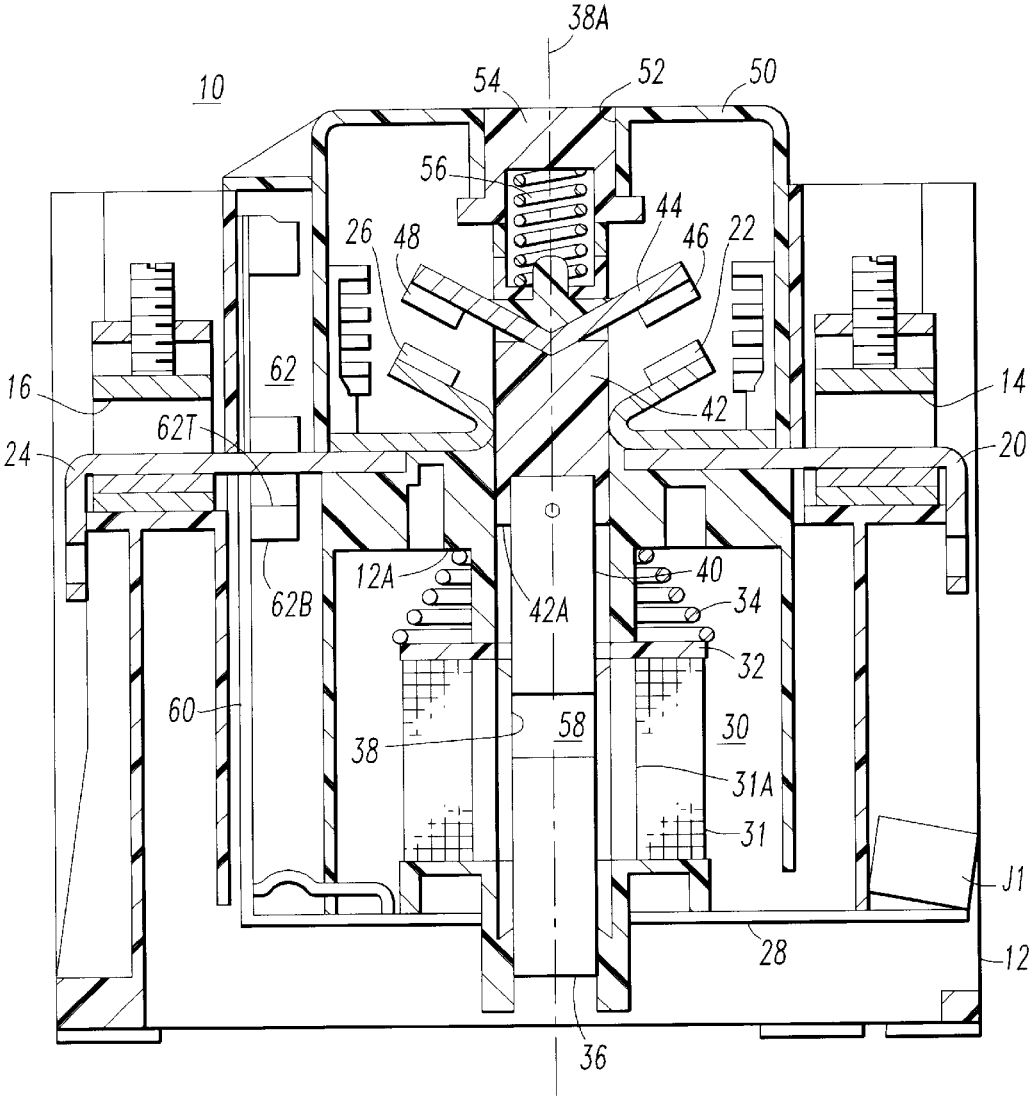
FIG. 2 is a vertical sectional view through the motor starter of FIG. 1.

Referring to FIGS. 1 and 2, a three phase electrical contactor or controller 10 is shown. This contactor is mechanically of the type shown in U.S. Pat. No. 4,980,794, which is hereby incorporated by reference. For the purpose of simplicity of illustration, the construction features of only one of the three poles will be described, it being understood that the other two poles are similar. Contactor 10 comprises a housing 12 made of suitable electrical insulating material such as a glass/nylon composition upon which are disposed electrical load terminals 14 and 16 for interconnection with an electrical apparatus, a circuit, or a system to be serviced or controlled by the contactor 10. Such a system is shown schematically in FIG. 3, for example. Terminals 14 and 16 may each form part of a set of three phase electrical terminals as mentioned previously. Terminals 14 and 16 are spaced apart and interconnected internally with conductors 20 and 24, respectively, which extend into the central region of the housing 12. There, conductors 20 and 24 are terminated by appropriate fixed contacts 22 and 26, respectively. Interconnection of contacts 22 and 26 will establish circuit continuity between terminals 14 and 16 and render the contactor 10 effective for conducting electrical current therethrough. A separately manufactured coil control board 28 may be securely disposed within housing 12. Disposed on the coil control board 28 is a coil or solenoid assembly 30 which may include an electrical coil or solenoid 31 disposed as part thereof. Spaced from the coil control board 28 and forming one end of the coil assembly 30 is a spring seat 32 upon which is securely disposed one end of a kick-out spring 34. The other end of the kick-out spring 32 bears against portion 12A of base 12 until movement of carrier 42 causes bottom portion 42A thereof to pick up spring 34 and compress it against seat 32. This occurs in a plane outside of the plane of FIG. 2. Spring 34 encircles armature 40 and it is picked up by bottom portion 42A, as the dimension of member 42 into the plane of FIG. 2 is larger than the diameter of the spring 34.

A fixed magnet or slug of magnetizable material 36 forms a core disposed within a channel 38 radially aligned with the solenoid or coil 31 of the coil assembly 30. Axially displaced from the fixed magnet 36 and imposed in the same channel 38 is a magnetic armature or magnetic flux conductive member 40 which is longitudinally (axially) movable in the channel 38 relative to the fixed magnet 36. At the end of the armature 40 and spaced away from the fixed magnet 36 is the longitudinally extending electrically insulating contact carrier 42 upon which is disposed an electrically conductive contact bridge 44. On one radial arm of contact bridge 44 is disposed a movable contact 46, and on another radial arm is the movable contact 48. Of course, it is to be remembered that there are three sets of such contacts a 3 pole contactor. Contact 46 engages contact 22 (22–46), and contact 48 engages contact 26 (26–48) to complete an internal circuit between the terminal 14 and terminal 16 as the contactor 10 closes. On the other hand, when the contact 46 is separated from the contact 22, and the contact 48 is spaced from contact 26, the internal circuit between the terminals 14 and 16 is open. The open circuit position is shown in FIG. 2. There is provided an arc box 50 which is disposed to enclose the contact bridge 44 and the terminals 22, 26, 46, and 48, to provide a partially enclosed volume in which electrical current flowing internally between the terminals 14 and 16 may be interrupted safely. There is provided centrally in the arc box 50 a recess 52 into which the crossbar 54 of the carrier 42 is disposed and constrained from moving transversely (radially) as shown in FIG. 2, but is free to move or slide longitudinally (axially) of the center line 38A of the aforementioned channel 38. Contact bridge 44 is maintained in carrier 42 with the help of a contact spring 56. The contact spring 56 compresses to allow continued movement of the carrier 42 toward slug 36 even after the contacts 22–46 and 26–48 have abutted or "made". Further compression of contact spring 56 greatly increases the pressure on the closed contacts 22–46 and 26–48 to increase the current-carrying capability of the internal circuit between the terminals 14 and 16 and to provide an automatic adjustment feature for allowing the contacts to attain an abutted or "made" position even after significant contact wear has occurred. The longitudinal region between the magnet 36 and the movable armature 40 comprises an air gap 58 in which magnetic flux exists when the coil 31 is electrically energized.

Externally accessible terminals on a terminal block J1 may be disposed upon the coil control board 28 for interconnection with the coil or solenoid 31, among other things, by way of printed circuit paths or other conductors on the control board 28. Electrical energization of the coil or solenoid 31 by electrical power provided at the externally accessible terminals on terminal block J1 and in response to a contact closing signal available at externally accessible terminal block J1 for example, generates a magnetic flux path through fixed magnet or slug 36, the air gap 58 and the armature 40. As is well known, such a condition causes the armature 40 to longitudinally move within the channel 38 in an attempt to shorten or eliminate the air gap 58 and to eventually abut magnet or slug 36. This movement is in opposition to, or is resisted by the force of compression of the kick-out spring 34 in the initial stages of movement and is further resisted by the force of compression of the contact spring 56 after the contacts 22–46 and 26–48 have abutted at a later portion of the movement stroke of the armature 40.

There may also be provided within the housing 12 of the contactor 10 an overload relay printed circuit board or card 60 upon which are disposed current-to-voltage transducers or transformers 62 (only one of which 62B is shown in FIG.

2). In those embodiments of the invention in which the overload relay board 60 is utilized, the conductor 24 may extend through the toroidal opening 62T of the current transformer or transducer 62B to form the primary of a current sensing transformer.

Figure 3:
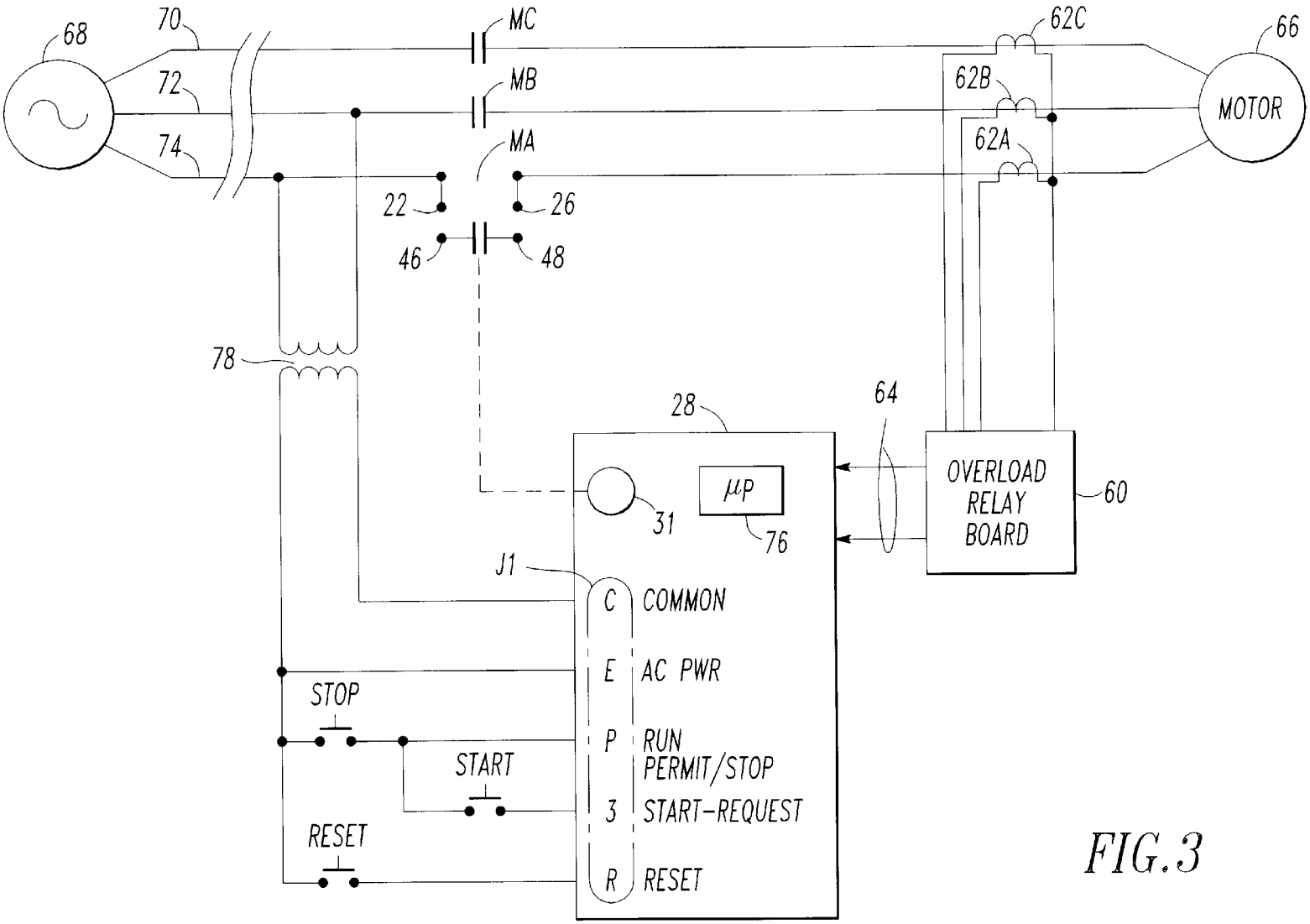
FIG. 3 is a schematic circuit diagram partially in block form of the motor starter of FIGS. 1 and 2 shown connected to control a motor.

FIG. 3 shows application of the motor starter 10 to control of a motor 66 energized by a three-phase power source 68 through three-phase conductors 70, 72 and 74. Electric power to the motor 66 through these conductors is controlled by the contactors MA, MB, MC which in turn are operated by the coil 31 on the coil control board 28. The current transformers 62A, 62B and 62C on the overload relay board 60 monitor the phase-currents in the motor 66. The terminal block J1 is shown on the coil control board 28 with its terminals designated: "C", "E", "P", "3" and "R". These designations represent the functions or connections: "COMMON", "AC POWER", "RUN PERMIT/STOP", "START-REQUEST", and "RESET", respectively. The overload relay board 60 has, among other things, a microprocessor 76 which performs a number of functions including overcurrent protection for the motor 66. In this regard, the microprocessor 76 integrates the square of the current supplied to the motor. As is well known, this $I^2t$ characteristic is a representation of the heating of the motor. The microprocessor 76 also controls energization of the coil 31. If the $I^2t$ value reaches a trip limit, microprocessor 76 terminates energization of the coil 31. The kick-out spring 34 in turn opens the separable contacts to disconnect the motor from the electric power source.

Power is provided to the coil control board 28 and the overload relay board 60 by way of a transformer 78, the primary winding of which is connected across the lines 72 and 74, for example. The secondary winding of the transformer 78 is connected to the "C" and "E" terminals of the terminal block J1. One side of the secondary winding of the transformer 78 may be connected to one side of a normally closed STOP push button and one side of the normally open RESET push button. The other side of the STOP push button is connected to the "P" input terminal of the J1 terminal block and one side of a normally opened START push button. The other side of the normally open START push button is connected to the "3" input terminal of the terminal block J1. The other side of the RESET push button is connected to the RESET terminal R of the terminal block J1. These push buttons may be manipulated in a manner well known in the art to provide control information to the control board 28 in the overload relay 60.

Figure 4:
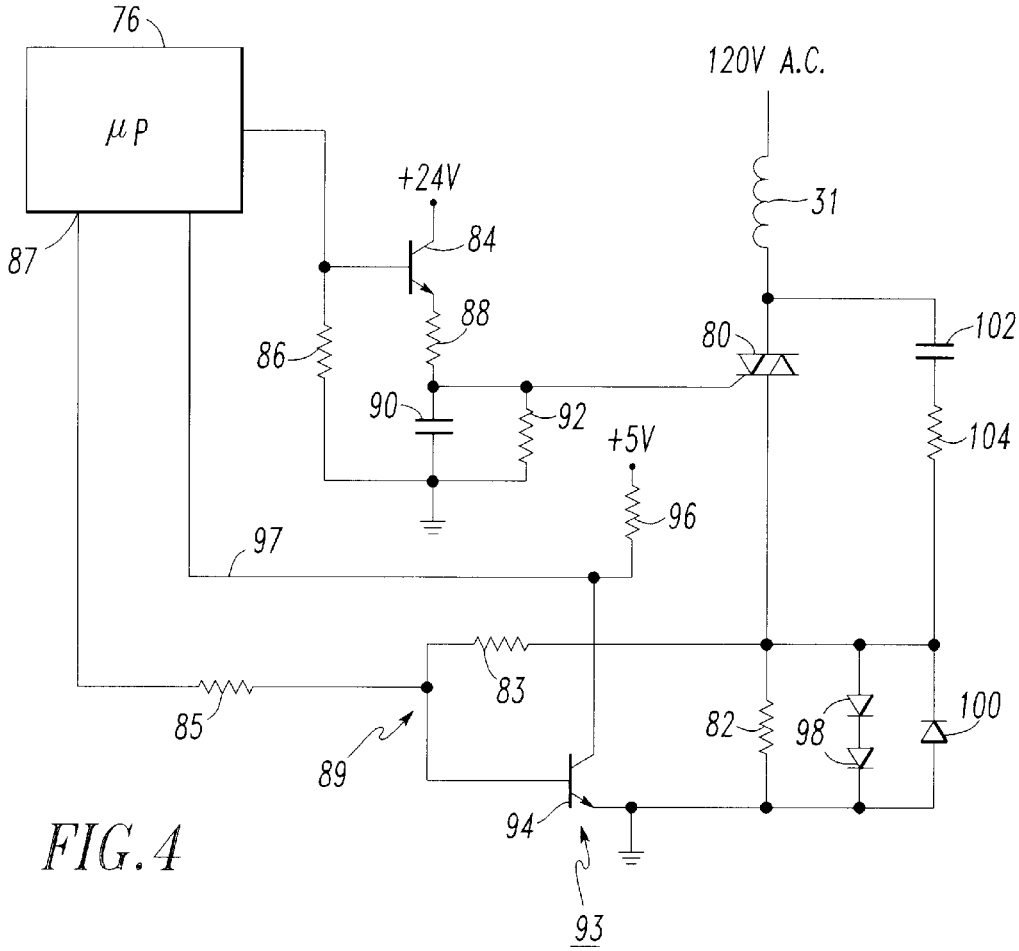
FIG. 4 is a schematic circuit diagram partially in block diagram form of one embodiment of the invention used in connection with an AC controlled coil.

FIG. 4 illustrates application of the invention to those units wherein the coil 31 of the contactor is energized by an AC voltage source. The coil 31 is connected to a 120 volt AC source through a triac 80 and a current sensing resistor 82. The triac 80 is turned on by a transistor 84 connected to the gate of the triac. The transistor 84 in turn is controlled by the microprocessor 76 which applies base drive current to the transistor 84. A pull down resistor 86 prevents turn on of the transistor 84 when the microprocessor is powering up. A resistor 88 limits current through the transistor 84 while a capacitor 90 protects the gate of the triac from transients. A resistor 92 provides a discharge path for the capacitor 90.

An indication of the amplitude of the coil current is fed back to the microprocessor 76 by a feedback circuit 93 including transistor 94 having its base bias determined by the current sensing resistor 82. A pull up resistor 96 applies a 5 volt signal to the microprocessor over lead 97 when transistor 94 is turned off. With the transistor 94 turned on, the input to the microprocessor goes low. Of course, during the negative half cycles of the AC voltage applied to the coil 31, the transistor 94 is biased off. During the positive half cycles, the bias is such that transistor 94 is turned on for the entire positive half cycle when the armature is separated from the core, and therefore, the inductance is low, and is turned on only about one-half of the positive half cycle when the armature is seated and the inductance is high. Thus, the signal applied to the microprocessor 76 has a 50% duty cycle when the contacts are open, and about a 25% duty cycle when the contacts are closed. As mentioned, the change in inductance of the coil from when it is seated and the contacts are closed to when it is separated from the core and the contacts are open is much greater than the effects of temperature on the resistance of the coil. It is also much greater than any effects of temperature on the junctions of the transistor 94, so that a 50% duty cycle on the signal applied by the transistor 94 to the microprocessor 76 is an indication that the contacts are open, or that the armature is not fully seated and therefore the contact pressure is not what it should be. Also then, a 25% duty cycle on the current feedback signal is an indication that the armature is fully seated and that therefore the contacts are closed with adequate pressure. As the current measurements do not have to be precise, this simple arrangement allows for an appropriate measurement of the coil current as an indication of contact position without the need for a conventional analog-to-digital converter for inputting the signal to the microprocessor.

The voltage across the current serving resistor 82 is applied to the base of transistor 94 through a resistor 83. A second resistor 85 is also connected to the base of transistor 94 and to an output 87 of the microprocessor 76. When the output 87 is set to a low impedance, the resistor 85 forms a voltage divider 89 with the resistor 83 to adjust the duty cycle of the signal generated by the transistor 94. When the impedance of output 87 is high, the base drive on transistor 94 is unaffected by resistor 85. This feature by which the bias on transistor 94 is made selectable allows for different coils or can be used for temperature adjustment.

The configuration of FIG. 4 also permits additional diagnostics to be performed. If the microprocessor 76 turns off the transistor 84, yet the feedback signal still indicates current flow through the coil, this is an indication that the triac 80 has failed. Furthermore, if the triac is turned off and there is no current feedback signal, but the current transformers sense current flowing through the main conductors to the motor, this is an indication that the contacts are welded closed. The diodes 98 protect the transistor 94 from excessive currents as well as limiting the power in current sensing resistor 82. A conventional snubber formed by the capacitor 102 and resistor 104 protects the triac 80.

Figure 5:
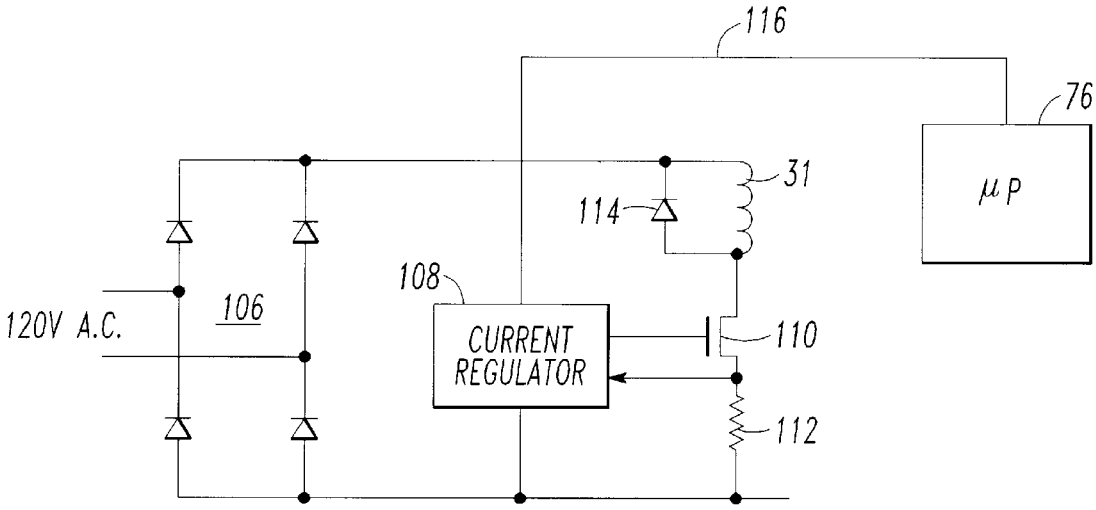
FIG. 5 is a schematic circuit diagram partially in block diagram form of a second embodiment of the invention incorporating a DC controlled coil.

FIG. 5 illustrates application of the invention to a switch in which the coil 31 is a DC coil. DC power for the coil 31 is derived from a 120 volt AC control voltage by a diode bridge 106. A current regulator 108 controls the DC current flowing through the coil 31 through a FET 110. The current sensing resistor 112 provides a current feedback signal to the current regulator 108. As previously mentioned, a large closing current is applied to the coil 31 to initiate movement of the armature and closure of the contacts. When the contracts are closed a reduced holding current is applied to the coil. The current through resistor 112 can be input to the current regulator by a circuit similar to that shown in FIG. 4 for the ac coil to indicate whether the current is above or below the selectable threshold.

As the current through the DC coil is set by the current regulator 108, and not the inherent inductance of the coil as in the case of the AC energized coil, a different technique is utilized to determine the inductance of the coil 31; and therefore, the position of the contacts. As is conventional, the DC coil 31 is shunted by a fly-back diode 114. The current regulator controls the current to the coil by gating portions of the DC pulses output by the bridge 106 to the coil 31. In the exemplary embodiment, the current regulator 108 regulates the duty cycle of the FET 110 at a frequency substantially higher than the 60 Hz of the supply voltage. The duty cycle provided during holding is sufficient to provide about twice the current needed to keep the contacts closed. When a determination is to be made as to the position of the contacts, the microprocessor reads the coil current as indicated by the voltage across the current sensing resistor 112. The microprocessor then commands the current regulator over the lead 116 to turn off the FET 110 for a predetermined interval. With the FET 110 turned off, current in the coil will circulate through the fly-back diode 114. The rate of the decay of the current in this loop will be dependent upon the resistance of the coil 31 and its inductance.

As mentioned, the difference in the inductance between when the armature is seated on the core, and therefore, the contacts are closed, and when there is a gap between the armature and the core, and therefore, the contacts are open, is significantly greater than the difference between the hot and cold resistance of the coil 31. Thus, the impedance of the coil is dominated by the inductance and therefore the change in the inductance will be reflected in the rate of decay of the current. The current is measured again at the conclusion of a predetermined time period which is less than the interval for which the current regulator is turned off. In the exemplary embodiment of the invention, this time period is one open cold coil time constant. If the coil 31 is closed, whether it is hot or cold, the coil current will be greater than 50% of the initial current. If the coil is open, then the current will be less than about 33% of the initial current. Thus, the measure of current is an indication of the position of the contacts. This technique will not result in drop out of the closed contacts, because as it will be recalled, the holding current is typically twice the current needed to prevent drop out of the armature. Typically, if the contacts are closed the current will only decay to about 87% of its initial value within the one open cold time constant of the coil. Thus, through resumption of the application of closing current to the coil following the second measurement, closed contacts will remain closed.

Figure 6:
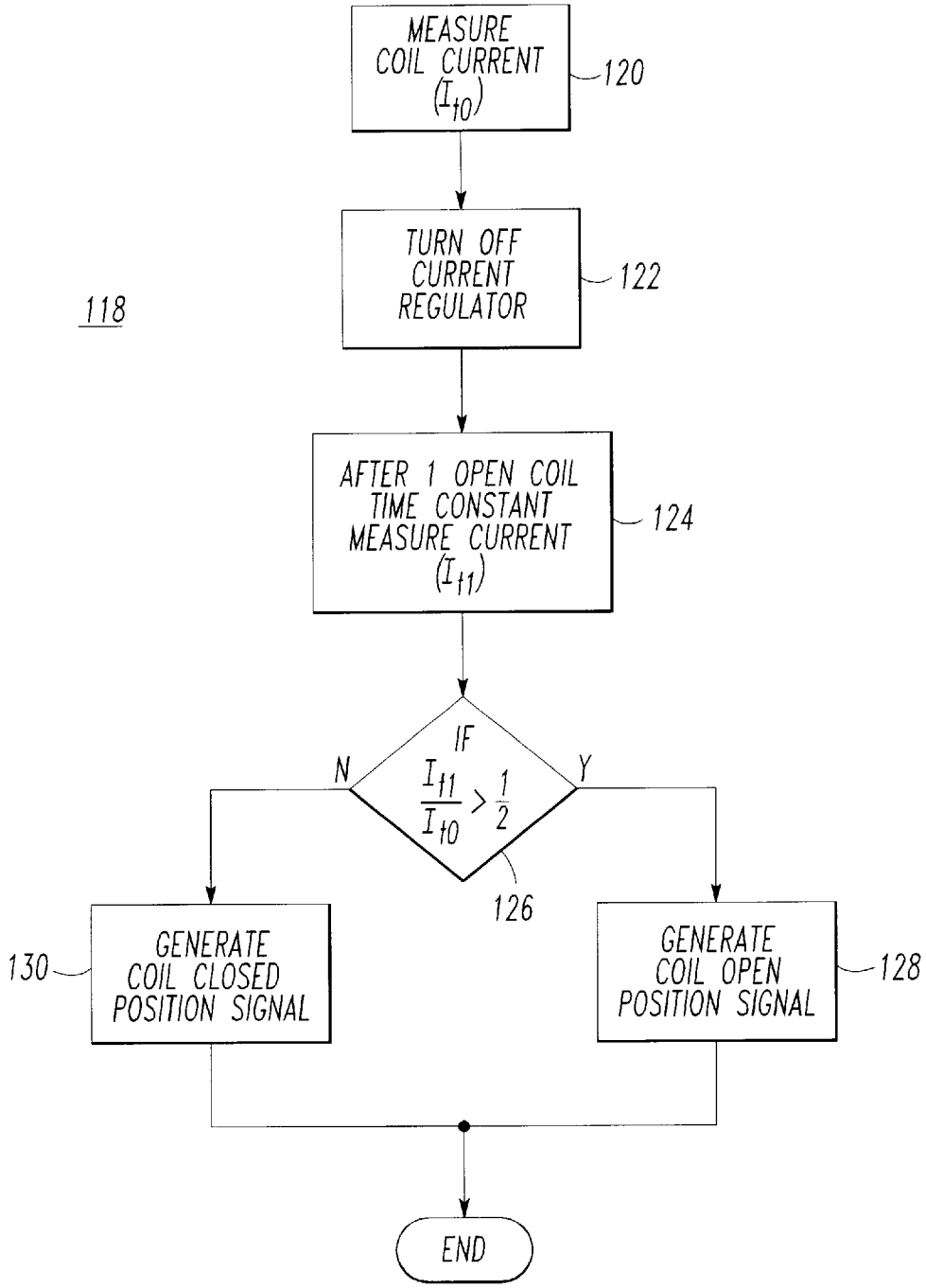
FIG. 6 is a flowchart of a routine used in the implementation of the invention.

FIG. 6, is a flowchart of a suitable routine 118 used by the microprocessor 76 to determine the position of the contacts in a switch having a DC coil in the manner discussed above. First an initial value of coil current, $I_{r0}$ is measured at 120. The current regulator is then turned off at 122. After one open cold time constant of the coil, a second measurement of coil current, $I_{r1}$, is measured at 124. If the second value of the current, $I_{r1}$, is more than 50% of the initial value of the current, $I_{r0}$, as determined at 126, then the microprocessor generates a coil closed position signal at 128, otherwise, it generates a coil open position signal at 130.

While specific embodiments of the invention have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of invention which is to be given the full breadth of the claims appended and any and all equivalents thereof.

What is claimed is:

1. An electromagnetic switch comprising:

separable contacts comprising a fixed contact structure and a movable contact structure having a closed position and an open position;

an electromagnet for opening and closing said separable contacts and comprising an AC coil, a core associated with said coil, an armature on which said moveable contact structure is carried, energizing means energizing said coil with an AC voltage to generate AC coil current and attract said armature toward said core to a closed position in which said separable contacts are closed, biasing means biasing said armature away from said core to an open position to form a gap between said core and said armature and in which said contacts are open, said coil having a first inductance when said armature is in said open position and a second inductance when said armature is in said closed position; and position indicating means monitoring coil current and generating a position signal indicating armature position and, therefore, contact position as a function of said coil current as affected by said first inductance and by said second inductance, said position indicating means comprising means measuring AC coil current generated by said AC voltage applied to said coil by said energizing means, means comparing said coil current to a threshold value and generating a position signal indicating that said separable contacts are closed when coil current is below said threshold value and indicating that said separable contacts are open when said coil current is above said threshold value.

2. The electromagnetic switch of claim 1 wherein said comparing means comprises means comparing said coil current to a threshold value which is no more than about one/half a nominal value of coil current when said set of contacts are open.

3. The electromagnetic switch of claim 1 wherein said means measuring coil current comprises signal generating means generating a digital signal having a duty cycle which is a function of coil current amplitude and means measuring said duty cycle.

4. The electromagnetic switch of claim 3 wherein said means measuring coil current further includes means biasing said signal generating means to adjust said duty cycle of said digital signal relative to said coil current amplitude.

5. The electromagnetic switch of claim 1 wherein said means measuring coil current comprises means adjusting for temperature.

6. The electromagnetic switch of claim 1 wherein said means measuring coil current comprises means adjusting measurement of coil current to accommodate for different coils.

7. An electromagnetic switch comprising:

separable contacts comprising a fixed contact structure and a movable contact structure having a closed position and an open position;

an electromagnet for opening and closing said separable contacts and comprising a DC coil, a core associated with said coil, an armature on which said moveable contact structure is carried, energizing means energizing said coil to generate coil current and attract said armature toward said core to a closed position in which said separable contacts are closed, said energizing means comprising means providing a regulated DC current to said DC coil and recirculating means recirculating said coil current, biasing means biasing said armature away from said core to an open position to form a gap between said core and said armature and in which said contacts are open, said coil having a first inductance when said armature is in said open position and a second inductance when said armature is in said closed position; and position indicating means monitoring coil current and generating a position signal indicating armature position, and therefore, contact position as a function of said coil current as affected by said first inductance and by said second inductance, said position indicating means comprising means turning off said regulated DC current to said DC coil for a first interval, means measuring a first value of said coil current after a predetermined time period less than said first interval, said means generating said position signal indicating said contacts are closed when said second value of coil current is at least a selected percentage of said first value and indicating that said separable contacts are open otherwise.

8. The electromagnetic switch of claim 7 wherein said means turning off said regulated DC current to said DC coil for a first interval comprises means turning off said regulated DC current for about one cold, open time constant of said DC coil.

9. The electromagnetic switch of claim 8 wherein said means generating said position signal comprises means setting said selected percentage to about 50%.

* * * * *